US010937302B2

(12) United States Patent
Sahai et al.

(10) Patent No.: US 10,937,302 B2
(45) Date of Patent: Mar. 2, 2021

(54) MONITORING CONTROL PANELS OF A FIRE CONTROL SYSTEM

(71) Applicant: Honeywell International Inc., Morris Plains, NJ (US)

(72) Inventors: Deepika Sahai, New Delhi (IN); Simon Foulkes, Oakham (GB); Karthik Kumar Davanam, Bangalore (IN); Amit Jain, Bangalore (IN); Rajesh Babu Nalukurthy, Bangalore (IN)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 16/521,968

(22) Filed: Jul. 25, 2019

(65) Prior Publication Data

US 2021/0027613 A1 Jan. 28, 2021

(51) Int. Cl.
*G08B 29/04* (2006.01)
*G08B 25/14* (2006.01)

(52) U.S. Cl.
CPC ..... *G08B 29/043* (2013.01); *G08B 25/14* (2013.01)

(58) Field of Classification Search
CPC ..... G08B 29/043; G08B 25/14; G05B 15/02
USPC ..... 340/506
See application file for complete search history.

(56) References Cited

U.S. PATENT DOCUMENTS

| | | | | |
|---|---|---|---|---|
| 8,155,767 | B2 * | 4/2012 | ElMankabady | G05B 15/02 700/83 |
| 8,275,404 | B2 * | 9/2012 | Berger | G06Q 10/06 455/521 |
| 9,905,119 | B2 | 2/2018 | Pettigrew et al. | |
| 9,978,256 | B1 * | 5/2018 | Norton | G08B 25/14 |
| 10,216,164 | B2 * | 2/2019 | Brown | G05B 15/02 |
| 10,565,859 | B2 * | 2/2020 | Gravel | H04W 4/90 |
| 10,679,491 | B1 * | 6/2020 | Nalukurthy | G08B 17/00 |
| 2009/0228812 | A1 * | 9/2009 | Keenan, Jr. | H04N 1/00976 715/762 |
| 2018/0169451 | A1 | 6/2018 | Moffa | |
| 2018/0240326 | A1 | 8/2018 | Norton et al. | |
| 2018/0359220 | A1 | 12/2018 | Trivelpiece et al. | |

OTHER PUBLICATIONS

Extended European Search Report for related EP Application No. 20185379.3, dated Nov. 13, 2020 (9 pgs).

* cited by examiner

*Primary Examiner* — John A Tweel, Jr.
(74) *Attorney, Agent, or Firm* — Brooks, Cameron & Huebsch, PLLC

(57) ABSTRACT

Methods, devices, and systems for monitoring control panels of a fire control system is described herein. In some examples, one or more embodiments include a computing device comprising a memory, a processor configured to execute instructions stored in the memory to receive, via a gateway device, data from a plurality of fire control panels of a fire control system, and detect an event associated with one of the fire control panels based on the received data, and a user interface configured to display information associated with the detected event.

17 Claims, 7 Drawing Sheets

MONITORING CONTROL PANELS OF A FIRE CONTROL SYSTEM

TECHNICAL FIELD

The present disclosure relates to methods, devices, and systems for monitoring control panels of a fire control system.

BACKGROUND

Large facilities (e.g., buildings), such as commercial facilities, office buildings, hospitals, and the like, may have fire control systems that can be used to prevent a fire from occurring in a facility, and/or to detect and/or manage a fire occurring in the facility. A fire control system may include a number of components located throughout the facility (e.g., on different floors of the facility). For example, a fire control system may include sensors (e.g., smoke detectors) that can sense a fire occurring in the facility, alarms that can provide a notification of the fire to the occupants of the facility, fans and/or dampers that can perform smoke control operations (e.g., pressurizing, purging, exhausting, etc.) during the fire, and/or sprinklers that can provide water to extinguish the fire, among other components. A fire control system may also include a physical fire control panel (e.g., box) installed in the facility that can be used by a user to directly control the operation of the components of the fire control system.

A gateway device may be used by a user (e.g., maintenance technician or operator) to perform inspections, maintenance, and/or upgrades, among other operations, on a fire control system (e.g., on the components of the fire control system) of a facility. For instance, the user may connect the gateway device to the fire control panel of the fire control system, and the gateway device can use a communication protocol to communicate with the fire control panel to perform the tasks of the operation.

DETAILED DESCRIPTION

Figure 1:
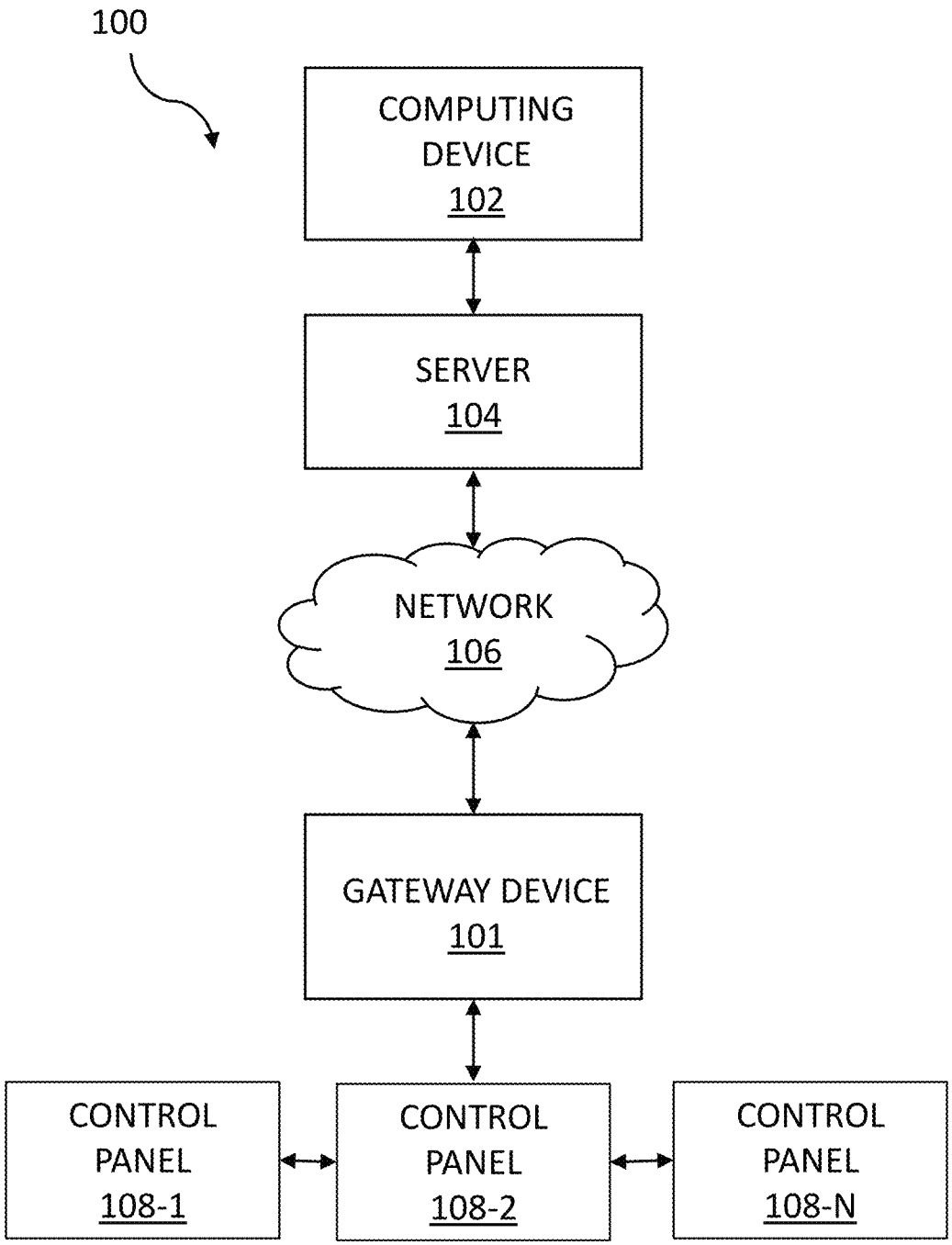
FIG. 1 illustrates an example of a fire control system, in accordance with one or more embodiments of the present disclosure.

Methods, devices, and systems for monitoring control panels of a fire control system are described herein. In some examples, one or more embodiments include a computing device comprising a memory and a processor to execute instructions stored in the memory to receive, via a gateway device, data from a plurality of fire control panels of a fire control system, and detect an event associated with one of the fire control panels based on the received data, and a user interface configured to display information associated with the detected event.

In previous fire control systems including multiple fire control panels, the control panels may not be linked to a single gateway device. Additionally, a user (e.g., a system integrator or technician) may not be able to monitor the maintenance, inspections, and/or upgrades of components of previous fire control systems from a remote location. Thus, users may be unable to easily remotely monitor the maintenance, inspections, and/or upgrades occurring in multiple facilities of previous fire control systems. For example, a user may be notified of an event and because the user is unable to remotely determine the severity and nature of the event, a technician may be unnecessarily sent or unprepared to provide maintenance. As such, a technician may be sent to a facility outside of business hours to address an event that could have been dealt with during business hours. In another example, a technician may arrive at a facility without the equipment needed to provide the required maintenance resulting in multiple trips. This can lead to a waste of time, money, and effort.

In contrast, monitoring control panels of a fire control system in accordance with the present disclosure can allow for a user to remotely access event information and make informed decisions based on the event information. For example, a plurality of fire control panels of the fire control system can be connected to a gateway device which can send data to a remotely located computing device (e.g., a desktop or mobile device). This can allow for a user to remotely view the real time status of components associated with the fire control panels. As such, a user can easily determine the severity of a detected event and/or determine when a device requires maintenance. This can help a user in planning, such that, in some cases service visits can be merged with maintenance visits. For example, if a user knows that a component is faulty, but does not require immediate service and there is a maintenance visit currently planned in the same facility as where the faulty component is located, the user can merge the two visits. As such, monitoring the fire control panels for a fire control system in accordance with the present disclosure can allow for a user to remotely monitor the fire control system and make informed decisions regarding maintenance, inspections, and/or upgrades, saving on time, effort, and money.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 102 may reference element "02" in FIG. 1, and a similar element may be referenced as 302 in FIG. 3.

As used herein, "a", "an", or "a number of" something can refer to one or more such things, while "a plurality of" something can refer to more than one such things. For example, "a number of components" can refer to one or more components, while "a plurality of components" can refer to more than one component. Additionally, the designator "N" as used herein, particularly with respect to reference numerals in the drawings, indicates that a number of the particular feature so designated can be included with a number of embodiments of the present disclosure. This number may be the same or different between designations.

FIG. 1 illustrates an example of a fire control system 100, in accordance with one or more embodiments of the present disclosure. The fire control system 100 can be the fire control system of a facility (e.g., building), such as, for instance, a large facility having a large number of floors, such as a commercial facility, office building, hospital, and the like. However, embodiments of the present disclosure are not limited to a particular type of facility. As an additional example, fire control system 100 can be the fire control system of a plurality of facilities.

Fire control system 100 can include a plurality of components located throughout a facility (e.g., on different floors of the facility) that can be used to detect and/or manage a fire occurring in the facility, and/or to prevent a fire from occurring in the facility. For example, the plurality of components may include sensors (e.g., smoke detectors) that can sense a fire occurring in the facility, alarms that can provide a notification of the fire to the occupants of the facility, fans and/or dampers that can perform smoke control operations (e.g., pressurizing, purging, exhausting, etc.) during the fire, and/or sprinklers that can provide water to extinguish the fire, among other components. For simplicity and so as not to obscure embodiments of the present disclosure, these components are not shown in FIG. 1.

As shown in FIG. 1, fire control system 100 can include a plurality of control panels (e.g., fire control panels) 108-1, 108-2, . . . , 108-N. Each of the control panels 108-1, 108-2, . . . , 108-N can be any different type of physical control panel, such as a control box, located in (e.g., installed) in the facility. Additionally, in an instance where fire control system 100 includes more than one facility, the different ones of the plurality of control panels 108-1, 108-2, . . . , 108-N can be installed within each respective facility.

As used herein, the term "fire control panel" refers to a controlling component of a fire control system. For example, a fire control panel can receive information from fire hardware devices in the facility, monitor operational integrity of fire hardware devices in the facility, control fire hardware devices in the facility, and/or transmit information about fire hardware devices in the facility, among other operations. As an example, a fire control panel can receive information from, monitor, control, and/or transmit information about sensors in the facility. As used herein, the term "sensor" refers to devices designed to detect and report fires.

Control panels 108-1, 108-2, . . . 108-N can be used by a user to monitor and/or control the components of fire control system 100. For instance, the user can use control panels 108-1, 108-2, . . . 108-N to directly control the operation of (e.g., actions performed by) the components. Further, control panels 108-1, 108-2, . . . 108-N can receive (e.g., collect) data, such as, for instance, real-time operational data, associated with the components. For instance, control panels 108-1, 108-2, . . . 108-N can receive the data directly from the components. Such data can include, for instance, current operational statuses, operational states, and/or properties of the components.

As shown in FIG. 1, fire control system 100 can include gateway device 101 that can be used by a user (e.g., maintenance technician or operator) to perform inspections, maintenance, and/or upgrades, among other operations, on the components of fire control system 100. For example, gateway device 101 can be connected to control panels 108-1, 108-2, . . . 108-N, and can communicate with control panels 108-1, 108-2, . . . , 108-N to receive the data associated with the components collected by control panels 108-1, 108-2, . . . 108-N. For instance, gateway device 101 can receive data from fire control panels 108-1, 108-2, . . . 108-N and send the data to a computing device, such as computing device 102, as will be further discussed herein. As an additional example, gateway device 101 may be permanently installed and/or connected at the facility or facilities, such that it can continuously send (e.g., push) the data collected by control panels 108-1, 108-2, . . . 108-N to computing device 102. That is, computing device 102 can continuously receive the data from fire control panels 108-1, 108-2, . . . , 108-N via gateway 101.

As used herein, a "network" can provide a communication system that directly or indirectly links two or more computers and/or peripheral devices and allows users to access resources on other computing devices and exchange messages with other users. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get a file or print on a network printer. Applications may also communicate with network management software, which can interact with network hardware to transmit information between devices on the network.

As used herein, the term "cloud", or distributed control network, can be used to refer to a server and/or computing device working in conjunction with other computing resources (hardware, software, logic, memory, processor, etc.) that can be used as a service over a communications network (in a wired and/or wireless manner over the internet). The server, computing device, and other computing resources can all be referred to as being part of the "cloud".

As shown in FIG. 1, fire control system 100 can include a server 104. Server 104 can be located remotely from the facility or facilities and, in some embodiments, can be part of and/or coupled to a computing device 102 that is part of a centralized management platform.

Server 104 can store data received from gateway device 101. For example, gateway device 101 can communicate with server 104 via network 106, as illustrated in FIG. 1. For example, gateway device 101 can detect connectivity to network 106, and send (e.g., transmit and/or upload) data, such as, for instance, the data received from control panels 108-1, 108-2, . . . 108-N to server 104 via network 106.

Network 106 can be a network relationship through which gateway device 101 and server 104 can communicate. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, network 106 can include a number of servers that receive information from, and transmit information to, gateway device 101 and server 104 via a wired or wireless network.

As shown in FIG. 1, fire control system 100 can include a computing device 102. Computing device 102 can be located remotely from the facility or facilities allowing for a user to more easily monitor fire control panels 108-1, 108-2, . . . , 108-N. As described further herein (e.g., in connection with FIGS. 2A-2E and 3), computing device 102 can include a user interface configured to display information associated with a detected event.

Computing device 102 can receive the data received from control panels 108-1, 108-2, . . . , 108-N via gateway device 101 and network 106, and detect an event associated with at least one of control panels 108-1, 108-2, . . . , 108-N, and/or a component associated with at least one of control panels 108-1, 108-2, . . . , 108-N, of fire control system 100 based on the data. Additionally, as described herein (e.g., in connection with FIGS. 2A-2E), computing device 120 can determine a severity of the detected event and/or monitor a status of the detected event.

The event can be, for example, a system fault or an action associated with maintenance, inspections, and/or upgrades for the fire control system. For instance, the event can include a fault in, and/or inspection of the associated control panel.

Computing device 102 can generate, based on the received data, event information associated with the detected event in response to detecting the event. As further described herein (e.g., in connection with FIGS. 2A-2E), event information can include a description of the event, a location of the event, and/or a number of devices associated with the event. Embodiments of the present disclosure, however, are not limited to a particular type(s) of event information.

Computing device 102 can provide the event information to the user via a desktop and/or mobile application. For example, computing device 102 can notify the user of the detected event and/or display information associated with the detected event via a desktop and/or mobile application. The notification can include details about the detected event, including, for example, information indicating the severity of the event and/or the status of the event.

Computing device 102 can display the event information on a user interface allowing for a user to remotely monitor the maintenance, inspections, and/or upgrades, among other operations, associated with fire control system 100. For instance, as described herein (e.g., in connection with Figured 2A-2E), computing device 102 can monitor the health and maintenance status of fire control system 100 in real time.

FIGS. 2A-2E are examples of user interface displays 220-1 through 220-5 for monitoring control panels of a fire control system, in accordance with one or more embodiments of the present disclosure. Displays 220-1 through 220-5 can be displayed on a user interface of a computing device, such as, for instance, the computing device previously described in connection with FIG. 1.

As described herein (e.g., in connection with FIG. 1), the fire control system can include a computing device configured to receive, via a gateway device, data from a plurality of fire control panels of the fire control system, detect an event associated with one of the fire control panels based on the received data, generate event information associated with the detected event in response to detecting the event in the at least one fire control panel, and display the event information on a user interface. This can allow for a user to more easily monitor the maintenance, inspections, and/or upgrades, among other operations, on the fire control system.

An event can include a system fault (e.g., a low battery, drained power supply, network communication failure, and/or temporary device disablement) or an action associated with maintenance, inspections, and/or upgrades for the fire control system. Upon detection of an event, the computing device can generate event information, such as a description of the event, a location of the event, and/or a number of devices associated with the event.

Figure 2A:
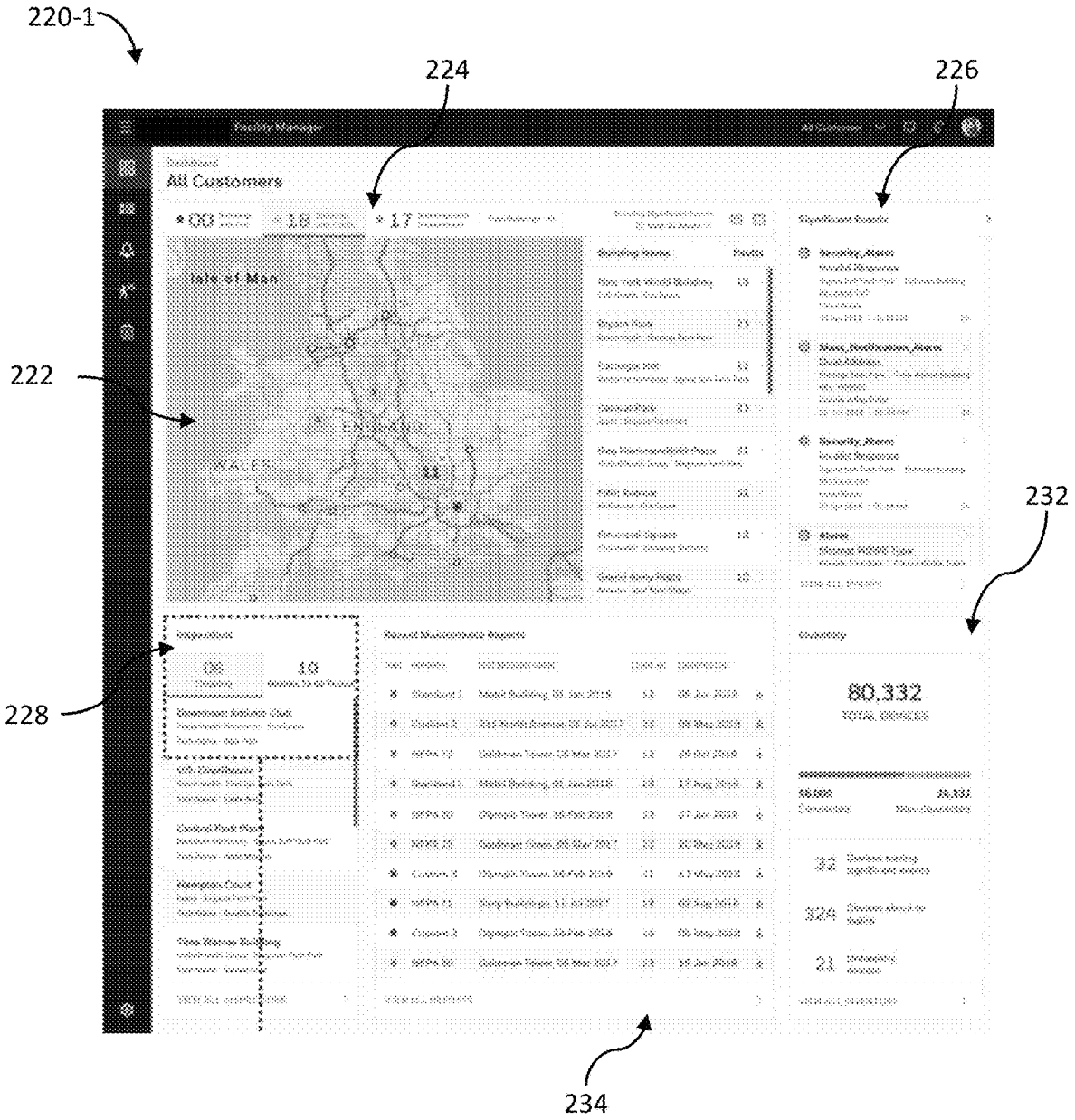
FIGS. 2A-2E are examples user interface displays for monitoring control panels of a fire control system, in accordance with one or more embodiments of the present disclosure.

As shown in FIG. 2A, display 220-1 can include event information including map 222 configured to show the location of facilities associated with the fire control system. Marking the location of the facilities on the map can make it easier for the user to determine the distance between the facilities which require maintenance. Being able to more easily determine the distance between the facilities can also help the user assign technicians in a more efficient manner.

As shown in FIG. 2A, the event information can include health data 224 of all facilities associated with the fire control system. Health data can include data relating to the operation of critical components of the fire control system. In such an example, the user can view a total number of facilities and/or events over a period of time. For instance, a user can choose to view the total number of events in the last 24 hours, such as the number of facilities that experienced a fire in the last 24 hours, the total number of buildings that experienced a fault in the last 24 hours, and/or the total number of buildings that experienced a disablement in the last 24 hours. Embodiments of the present disclosure, however, are not limited to a particular period of time of event type(s).

As shown in FIG. 2A, the event information can include significant events 226 corresponding to all of the facilities associated with the fire control system. A significant event can include a detected event associated with the fire control system. Details of a significant event can be displayed, such as the time, date, location, and description of the detected event, among other details. For example, a user can easily see that an alarm was activated in a facility in the last 24 hours and based on the details (e.g., time, location, severity of a detected event), the user can make an informed decision on when to service the facility.

As shown in FIG. 2A, the event information can include inspection statuses 228 of devices for the fire control system. For example, information indicating ongoing inspection statuses along with the devices that are due for maintenance (e.g., testing) can be displayed, such as a total number of devices that are currently being inspected and/or a total number of devices that require maintenance. Additionally, the information can include what facility the device is located within and the technician that is performing the maintenance. Embodiments of the present disclosure, however, are not limited to such information.

As shown in FIG. 2A, the event information can include inventory 232, which includes details associated with the total number of devices within the fire control system. Details associated with the total number of devices can include the number of devices that are connected, the number of devices that are not connected, the number of devices that are experiencing an event, the number of devices about to expire, and/or the number of devices that are determined to be unhealthy (e.g., faulty).

As shown in FIG. 2A, the event information can include recent maintenance reports 234. Each time a technician performs maintenance, inspections, and/or upgrades for the fire control system, a maintenance report can be created. The maintenance report can include details (e.g., time, location, description, etc.) associated with the maintenance, inspections, and/or upgrade.

Figure 2B:
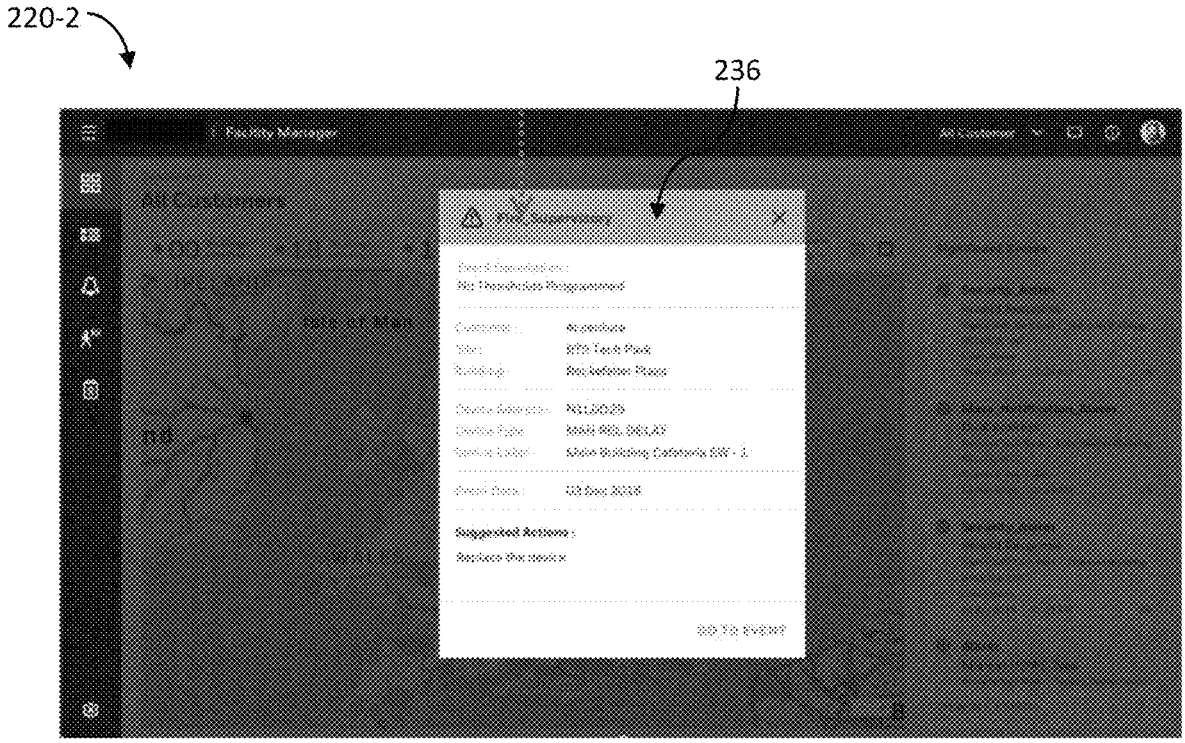

FIG. 2B is another example of a display 220-2 that can include event information. As shown in FIG. 2B, the event information can include event severity details 236. Severity details 236 can include a description of a detected event and a suggested action. For example, depending on the severity level of the detected event, the user can be notified of a suggested action, such as to replace the device.

Figure 2C:
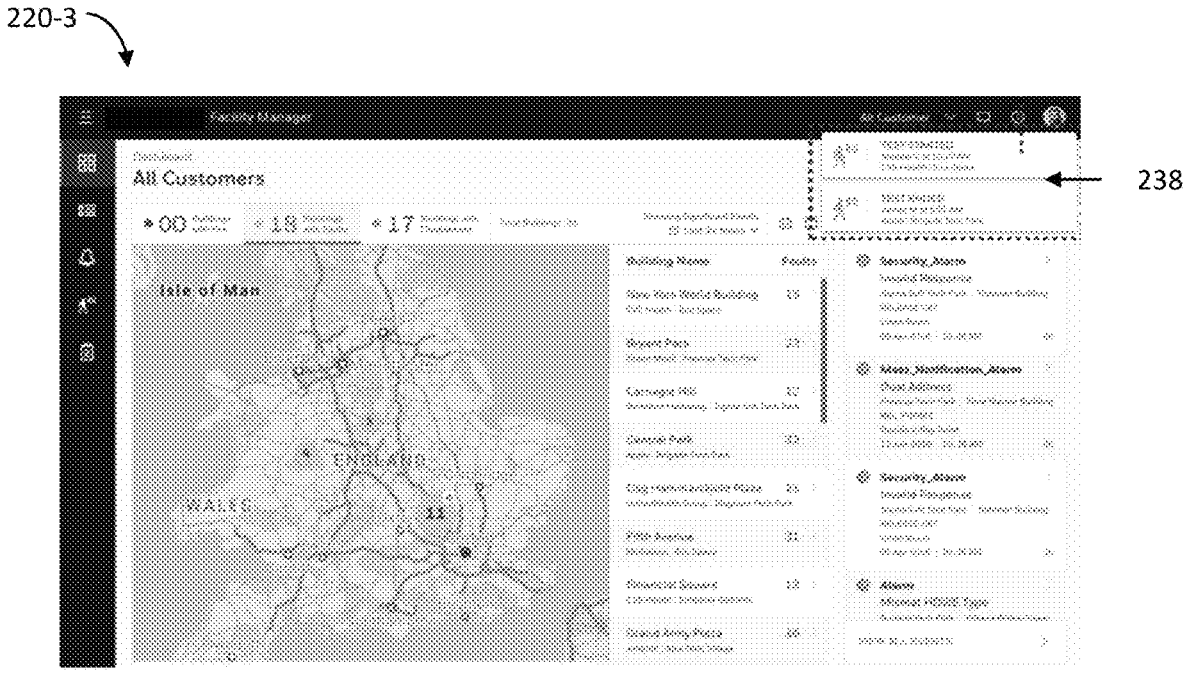

FIG. 2C is another example of a display 220-3 that can include event information. As shown in FIG. 2C, the event information can include a notification 238 of when a technician starts and/or ends maintenance on a device or at a facility. Notification 238 can include the name of the technician performing the maintenance, the start or end time of the maintenance, and/or the location where maintenance is being performed, among other details corresponding to the maintenance.

Figure 2D:
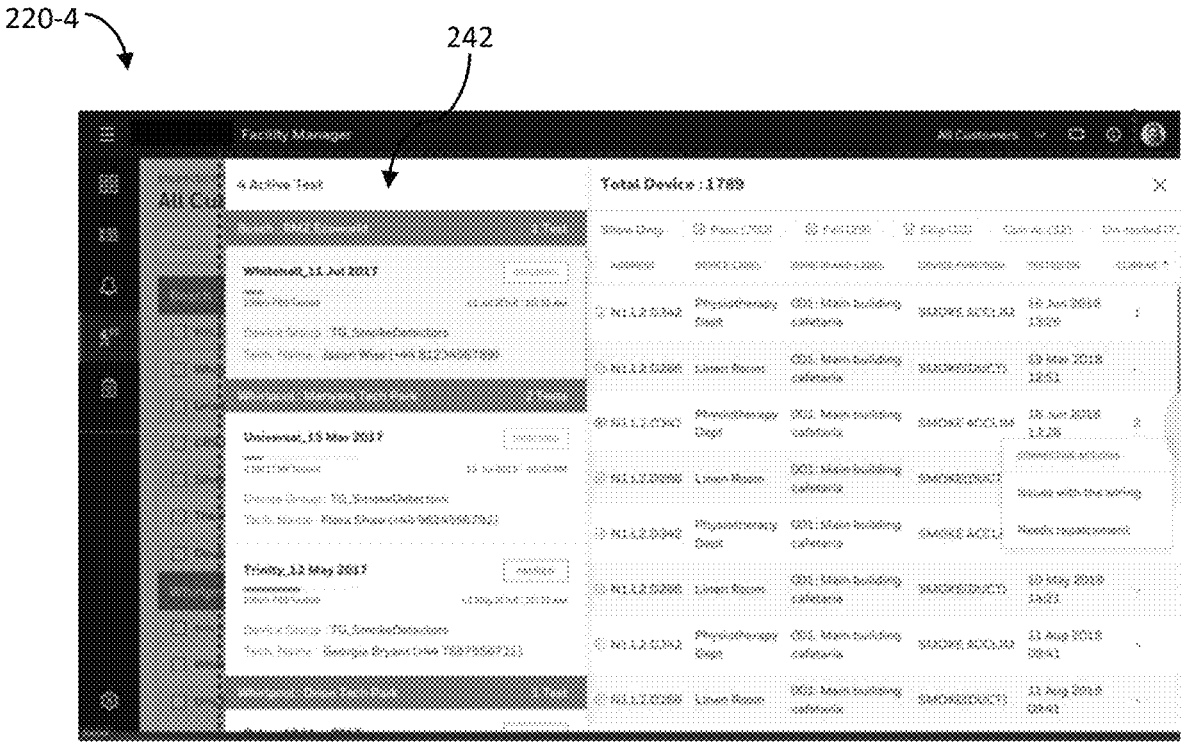

FIG. 2D is another example of a display 220-4 that can include event information. As shown in FIG. 2D, the event information can include active test details 242. For example, active test details 242 can include details corresponding to all maintenance, inspections, and/or upgrades currently being performed, such as a real time progress report (e.g., ongoing, paused, etc.), how many devices have passed, failed, have been skipped, and/or are remaining, the location where the maintenance is being performed, the device which maintenance are being performed on, and a name of the technician performing the maintenance, among other details.

Figure 2E:
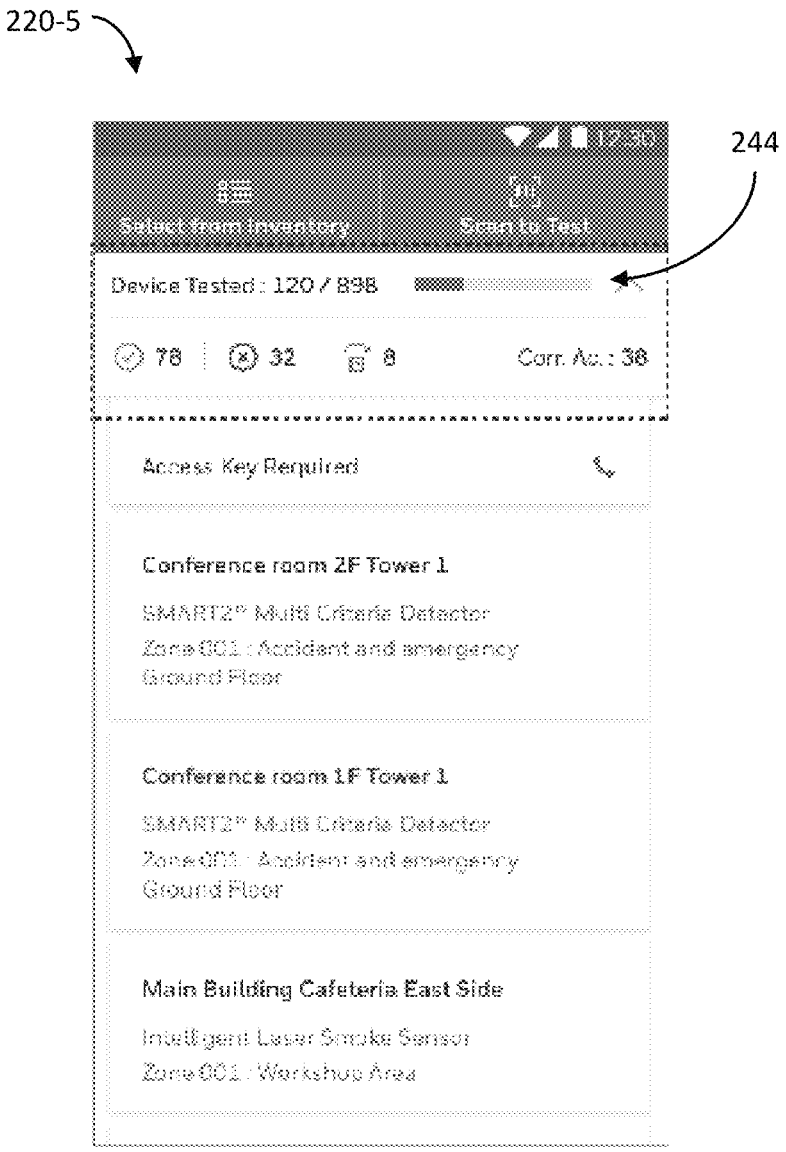

FIG. 2E is another example of a display 220-5 that can include event information. As shown in FIG. 2E, the event information can include maintenance details 244, which can be entered by a technician while performing maintenance on a device for the fire control system. Maintenance details can include the location where the maintenance is being performed, the device which maintenance are being performed on, and a name of the technician performing the maintenance, among other details. For example, the technician can enter such information via a mobile application. Upon entering the information, the information can be synched with a desktop application of a second computing device (e.g., a remotely located desktop). Information can be added manually by the technician and/or by scanning a barcode located on the device.

Figure 3:
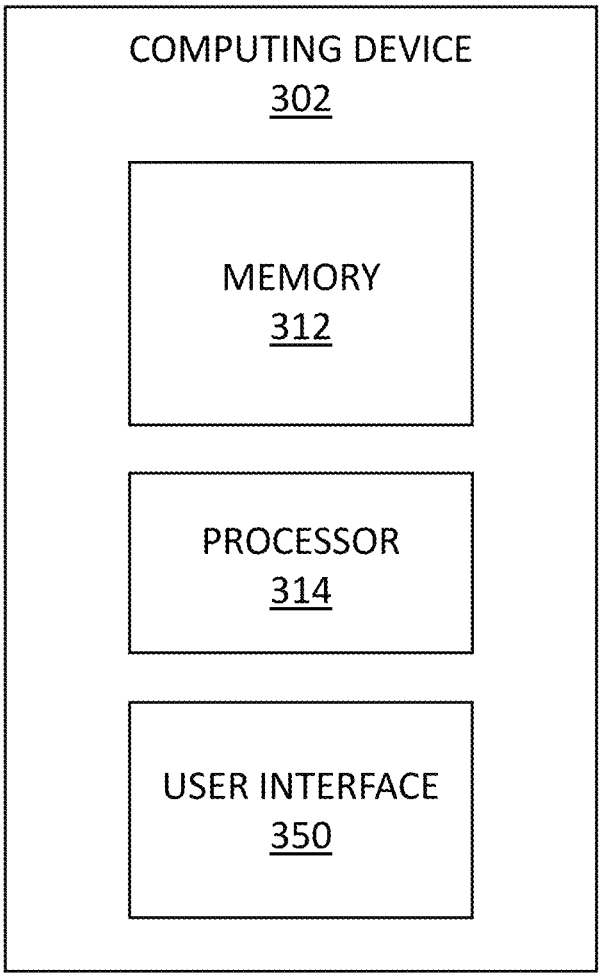
FIG. 3 is an example of an illustration of a computing device, in accordance with one or more embodiments of the present disclosure.

FIG. 3 is an example of an illustration of a computing device 302, in accordance with one or more embodiments of the present disclosure. Computing device 302 can be a laptop computer, desktop computer, or mobile device such as, for instance, a smart phone or tablet, among other types of computing device. Computing device 302 can include a processor 314, memory 312, and user interface 350, as illustrated in FIG. 3.

The memory 312 can be any type of storage medium that can be accessed by the processor 314 to perform various examples of the present disclosure. For example, the memory 312 can be a non-transitory computer readable medium having computer readable instructions (e.g., computer program instructions) stored thereon that are executable by the processor 314 for monitoring fire control panels of a fire control system, in accordance with the present disclosure.

The memory 312 can be volatile or nonvolatile memory. The memory 312 can also be removable (e.g., portable) memory, or non-removable (e.g., internal) memory. For example, the memory 312 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 312 is illustrated as being located within computing device 302, embodiments of the present disclosure are not so limited. For example, memory 312 can also be located internal to another computing resource (e.g., enabling computer readable instructions to be downloaded over the Internet or another wired or wireless connection).

As illustrated in FIG. 3, computing device 302 can include a user interface 350. For example, the user interface 350 can display event information associated with a detected event associated with a fire control panel of the fire control system in accordance with the present disclosure (e.g., as previously described in connection with FIGS. 1 and 2E-2E).

A user (e.g., operator) of computing device 302 can interact with computing device 302 via user interface 350. For example, user interface 350 can provide (e.g., display and/or present) information to the user of computing device 302, and/or receive information from (e.g., input by) the user of computing device 302. For instance, in some embodiments, user interface 350 can be a graphical user interface (GUI), that can include a display (e.g., screen) that can provide and/or receive information to and/or from the user of computing device 302. The user interface 350 can be, for instance, a touchscreen (e.g., the GUI can include touchscreen capabilities). Alternatively, the user interface 350 can be a television, computer monitor, mobile device screen, other type of display device, or any combination thereof, connected to computing device 302 and configured to receive a video signal output from the computing device 302.

As an additional example, user interface 350 can include a keyboard and/or mouse the user can use to input information into computing device 302, and/or a speaker that can play audio to, and/or receive audio (e.g., voice input) from the user. Embodiments of the present disclosure, however, are not limited to a particular type(s) of user interface.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A computing device for monitoring control panels of a fire control system, comprising:

a memory;

a processor configured to execute instructions stored in the memory to:

receive, via a gateway device, data from a plurality of fire control panels of a fire control system of a facility; and detect an event associated with one of the fire control panels based on the received data, wherein the detected event is an upgrade of an existing component of the fire control system located in the facility and controlled by the fire control panel, wherein the existing component of the fire control system is a sensor, an alarm, a fan, a damper, or a sprinkler; and a user interface configured to display information associated with the detected event.

2. The computing device of claim 1, wherein the data includes current operational statuses, operational states, and/or properties of components associated with the plurality of fire control panels.

3. The computing device of claim 1, wherein the processor is configured to execute the instructions to notify a user of the detected event.

4. The computing device of claim 1, wherein the processor is configured to execute the instructions to continuously receive the data via the gateway device.

5. The computing device of claim 1, wherein the processor is configured to execute the instructions to generate the information associated with the event based on the received data.

6. A non-transitory computer readable medium having computer readable instructions stored thereon that are executable by a processor to:

receive, via a gateway device, data from a plurality of fire control panels of a fire control system of a facility;

detect an event associated with at least one of the fire control panels based on the received data, wherein the detected event is an upgrade of an existing component of the fire control system located in the facility and controlled by the fire control panel, wherein the existing component of the fire control system is a sensor, an alarm, a fan, a damper, or a sprinkler;

generate event information associated with the detected event in response to detecting the event in the at least one fire control panel; and display the event information on a user interface.

7. The medium of claim 6, wherein the computer readable instructions are executable by the processor to determine a severity of the detected event.

8. The medium of claim 6, wherein the computer readable instructions are executable by the processor to monitor a status of the detected event.

9. A system for monitoring control panels of a fire control system of a facility, comprising:

a plurality of fire control panels;

a gateway device configured to receive data from the plurality of fire control panels; and a computing device configured to:

receive the data from the gateway device;

detect an event associated with at least one of the fire control panels based on the data, wherein the detected event is an upgrade of an existing component of the fire control system located in the facility and controlled by the at least one fire control panel, wherein the existing component of the fire control system is a sensor, an alarm, a fan, a damper, or a sprinkler;

generate event information associated with the detected event in response to detecting the event; and provide the event information to the user in response to detecting the event in the at least one fire control panel.

10. The system of claim 9, wherein the computing device includes a user interface configured to display the event information.

11. The computing device of claim 9, wherein the plurality of fire control panels are located in more than one facility.

12. The system of claim 9, wherein the plurality of control panels and the gateway device are installed in the facility, and wherein the computing device is located remotely from the facility.

13. The system of claim 9, wherein the computing device is configured to provide the event information to the user via a desktop application.

14. The system of claim 9, wherein the computing device is configured to provide the event information to the user via a mobile application.

15. The system of claim 9, wherein the event information includes information associated with the component of the fire control system.

16. The system of claim 9, wherein the event information includes a location of the event.

17. The system of claim 9, wherein the event information includes a description of the event.

* * * * *